US006948447B1

(12) United States Patent
Yingling

(10) Patent No.: US 6,948,447 B1
(45) Date of Patent: Sep. 27, 2005

(54) BOOKMARK WITH NOVEL LINE AND TEXT LOCATORS

(76) Inventor: Glenn Edgar Yingling, 28 Lawrence Ave., Newark Valley, NY (US) 13811-0062

( * ) Notice: Subject to any disclaimer, the term of this patent is extended or adjusted under 35 U.S.C. 154(b) by 0 days.

(21) Appl. No.: 10/946,933

(22) Filed: Sep. 22, 2004

(51) Int. Cl.[7] ..... G08B 1/00

(52) U.S. Cl. ..... 116/234; 116/306; 116/309; 116/240

(58) Field of Search ..... 116/234, 235, 116/236, 237, 238, 239, 240, 306, 307, 309, 318; 281/42; D19/34

(56) References Cited

U.S. PATENT DOCUMENTS

| | | | | | |
|---|---|---|---|---|---|
| 399,768 | A | * | 3/1889 | Mehrer | 116/235 |
| 650,664 | A | * | 5/1900 | Wireback | 116/235 |
| 670,766 | A | * | 3/1901 | Carleton | 116/309 |
| 759,427 | A | * | 5/1904 | Fairchild | 116/235 |
| 828,353 | A | * | 8/1906 | Walsh | 116/309 |
| 868,470 | A | * | 10/1907 | Orgain | 116/312 |
| 1,018,816 | A | * | 2/1912 | Eilers | 116/309 |
| 1,966,340 | A | * | 7/1934 | Forbring et al. | 116/235 |
| 2,630,777 | A | | 8/1953 | Johnson | |
| 3,266,456 | A | | 8/1966 | O'Reilly | |
| 4,608,772 | A | * | 9/1986 | Gill | 116/309 |
| 4,901,665 | A | | 2/1990 | Carlin | |
| D307,442 | S | * | 4/1990 | Cooper | D19/34 |
| 5,081,948 | A | | 1/1992 | Walsh | |
| 5,311,835 | A | | 5/1994 | Knowles | |
| D351,192 | S | * | 10/1994 | Klein | D19/34 |
| 5,377,612 | A | | 1/1995 | Catalanos | |
| 5,437,240 | A | | 8/1995 | Miroyan | |
| 5,515,809 | A | | 5/1996 | Weinberg | |
| 5,577,459 | A | | 11/1996 | Alden | |
| 5,632,225 | A | | 5/1997 | Krasner | |
| 6,109,205 | A | * | 8/2000 | Smith | 116/234 |
| 6,205,947 | B1 | | 3/2001 | Drew | |
| 6,298,804 | B1 | | 10/2001 | Kamen | |
| 6,550,417 | B2 | | 4/2003 | Hendershot | |
| 6,796,266 | B1 | * | 9/2004 | Castillo | 116/234 |

FOREIGN PATENT DOCUMENTS

| | | | | |
|---|---|---|---|---|
| GB | 2222387 A | * | 3/1990 | B42D/9/00 |

* cited by examiner

*Primary Examiner*—Christopher W. Fulton
*Assistant Examiner*—Travis Reis

(57) ABSTRACT

A bookmark (40) consisting of two alterable open book icons (30) (60) plus an adjustable highlighting device (24). Bookmark (40) provides for marking books with both single column pages and double column pages. Markings are made to a quarter of the text on a page and to a quarter of the text on a column. Paragraphs and sentences of five lines or more may also be marked. The markings will be retained even if bookmark (40) were to fall out on opening the book. Under normal usage, a single line-of-text can be marked. The bookmark (40) is usable in both soft-cover books and larger hard-cover books.

6 Claims, 10 Drawing Sheets

BOOKMARK WITH NOVEL LINE AND TEXT LOCATORS

CROSS-REFERENCE AND RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to bookmarks, specifically for identifying the location of the text on a page, the text on a page column, and the lines of text where reading is to recommence.

2. Prior Art

Often when a reader tires or runs out of time, the reader will not finish at the end of a chapter or an otherwise convenient stopping place in a book that is being read. Hence, when the reader returns, some method is needed for finding where reading was left off. Hopefully, the reader will not have to reread large portions of the text in order to commence at the proper spot in the book. For this purpose, many markers have been created in an attempt to solve the problem. These devices are generally referred to as bookmarks.

A goal for such bookmarks is that they be inexpensive, easy for the reader to use, and have dimensions suitable for both small paperbacks and the larger hard-cover books. Also, such bookmarks need to identify which page, which column, which section of text on the page or column, and which specific line or lines of text are being marked. It is also desirable that the bookmark retain its information, even if the bookmark is jostled or falls out of the opened book. Unfortunately, the design of the perfect bookmark has been approached but never attained.

Bookmarks of many designs have been invented over the years. However, even though many designs provide a degree of utility, individually they do not entirely solve the reader's perceived problem. They are often lacking in one thing or another, including the following:

a) They are not always easy to use, either because of their size or simplicity. Because of their simplicity they are often annotated with arrows, lines, numbers, letters, and instructions necessary to the reader. Oftentimes they require the use of both hands to complete the marking of the reader's spot in the book. Other times it is necessary to turn the bookmark over and upside down to get the proper orientation for insertion into the book. U.S. Pat. No. 6,298,804 KAMEN (2001) requires the reader to be aware of subtle differences in the notches or points on the bookmark in order to determine which page or column of a page is being marked. Letters and arrows are needed to determine what orientation the bookmark must be placed in order to mark the reader's spot. U.S. Pat. No. 6,205,947 DREW (2001) requires that the reader use one hand to hold the bookmark down while using the other hand to move the marking indicator up or down a flexible strap while adjusting an arrow indicator for pointing right or left.

b) Many bookmarks are limited in their capabilities to mark pages, columns of text, paragraphs, and lines of text. U.S. Pat. No. 5,377,612 CATALANOS (1995) marks only to a single page of a book. U.S. Pat. No. 5,577,459 ALDEN (1996) marks only to a single paragraph and additionally limits its marking to books that have numbered paragraphs. U.S. Pat. No. 5,081,948 WALSH (1992), U.S. Pat. No. 5,311,835 KNOWLES (1994), U.S. Pat. No. 5,632,225 KRASNER (1997), U.S. Pat. No. 6,205,947 DREW (2001), and U.S. Pat. No. 2,630,777 JOHNSON (1952) make no provision for marking a column in a book with two columns per page.

c) Few bookmarks make provisions for retaining the marking information if they are jostled out of place or if they fall out of the book when the book is opened. Attempts have been made to alleviate the problem with adhesives or some sort of clips attached to the leaves of the book. U.S. Pat. No. 4,901,665 CARLIN (1990), U.S. Pat. No. 5,081,948 WALSH (1992), U.S. Pat. No. 5,311,835 KNOWLES (1994), U.S. Pat. No. 5,437,240 MIROYAN (1995), U.S. Pat. No. 5,632,225 (KRASNER) (1997), U.S. Pat. No. 6,298,804 KAMEN (2001), and U.S. Pat. No. 6,550,417 HENDERSHOT (2003) all lose the marking information if they fall out when the book is opened.

d) It is desirable that a bookmark be of a convenient size and shape, not damage a book through its use, and also be inexpensive. A voracious reader, who often may have several books partially read, may need to have several bookmarks in use at one time. U.S. Pat. No. 3,266,456 O'REILLY (1965) does not appear to be inexpensive. Additionally, it is of a size and shape that is cumbersome for use in both paperback books and large hard-cover books. U.S. Pat. No. 5,515,809 Weinberg (1996) uses adhesive to mark a spot which introduces potential risk to fragile books

OBJECTS AND ADVANTAGES

Accordingly, this bookmark provides a more encompassing solution to the desires of the reader. The objectives and advantages of this bookmark include, but are not limited to, the following:

(a) to provide a bookmark with no arrows, lines, numerals or letters needed in performing its function;

(b) to provide a bookmark that marks which page of two pages of an open book is to be used;

(c) to provide a bookmark which can mark one of several sections of a page of text;

(d) to provide an adjustable bookmark for marking books which have plurality of columns of text on one page;

(e) to provide a bookmark that marks which section of text is to be used, on either a single-column page or a two-column page;

(f) to provide a bookmark that can mark a line-of-text in a book that contains both single-column and double-column pages in the same book;

(g) to provide a bookmark with a plurality of line markers which, in conjunction with the adjustable bookmark, can be used to mark a single line-of-text;

(h) to provide a bookmark that the reader can adjust using only one hand;

(i) to provide a bookmark that may be used in a vertical orientation to mark a paragraph or a single line-of-text in books of typical paperback book size;

(j) to provide a bookmark that will retain a marked section to within five lines of text, even if the bookmark falls out when the book is opened and (k) to provide a bookmark that is inexpensive to fabricate.

Further objects and advantages of this invention will become apparent from a consideration of the drawings and ensuing description.

SUMMARY

In accordance with the present invention, the bookmark described herein has several novel attributes not normally found in a bookmark. They include, but are not limited to, the following:

1) An alterable icon, with a likeness of an open book, is used as the marker

One side of the bookmark has an alterable icon with a likeness of an open book with a single column of text on each page. The reverse side has a second alterable icon with a likeness of an open book with two columns of text on each page. Each page of text and each column of text in the icons have a plurality of apertures. The apertures can be selectively highlighted, one at a time, by the adjustable highlighter device, to indicate one quarter of a page of text or one quarter of a column of text. The use of the icon, with a likeness of the book being read, obviates the need for any arrow, numbers, lines or letters to aid the reader in using the bookmark. Therefore, this bookmark contains no such aids.

2) Four line-of-text markers instead of only one

Many bookmarks provide for marking a line-of-text utilizing only one arrow or marker. This causes a need to position such bookmarks over the whole range of the page, from the extreme top of the page to the extreme bottom of the page, in the marking of a single line. These extremes often cause the bookmark to not have a good anchor in the book. The bookmark will stick far above or far below the book leaving little in the book to retain or anchor it. The designer often resorts to making the bookmark longer than desirable or to adding marking arrows that must be rotatable or made movable on a sliding mechanism, increasing cost and complexity.

This bookmark has four pairs of line-of-text markers on each side of the bookmark of which only one is used at a time. The one marker out of the four pairs is selected by the reader by observing which aperture is highlighted in the open book icon. For example, if the open book icon shows that the reader is in the third quarter of the text, he will use the third quarter text line marker. This insures that the bookmark is positioned near the center of the page and never has to be moved vertically more than a quarter of a page to mark a line of text.

3) An alternative approach to marking a section of as few as five lines of text

For the reader who chooses, the open book icon may be used to mark a paragraph or a sentence or two of text consisting of as few as five lines of text.

4) Markings are retained if the bookmark falls from the book when it is opened

The bookmark retains the marking to a quarter page of text, a quarter column of text, a paragraph or any text of at least five lines should the bookmark fall from the book when opened.

5) One size is suitable for use in both soft-cover and hard-cover books

The bookmark is conveniently sized for small books such as paperback sizes. Provisions for marking a line of text in taller hard-cover books is provided by using the left and right edges of the bookmark as line-of-text markers. Since the hard-cover book may be tall, the reader positions the bookmark horizontally. The reader then positions the bookmark so that the selected edge lines up with the line-of-text to be marked. The edge selected is determined by the position of the highlighted aperture in the alterable open book icon. Because the bookmark is positioned horizontally, it will extend out from the right edge of the book, thereby providing good visibility when the book is closed.

DRAWINGS

Figures

Figure 1:
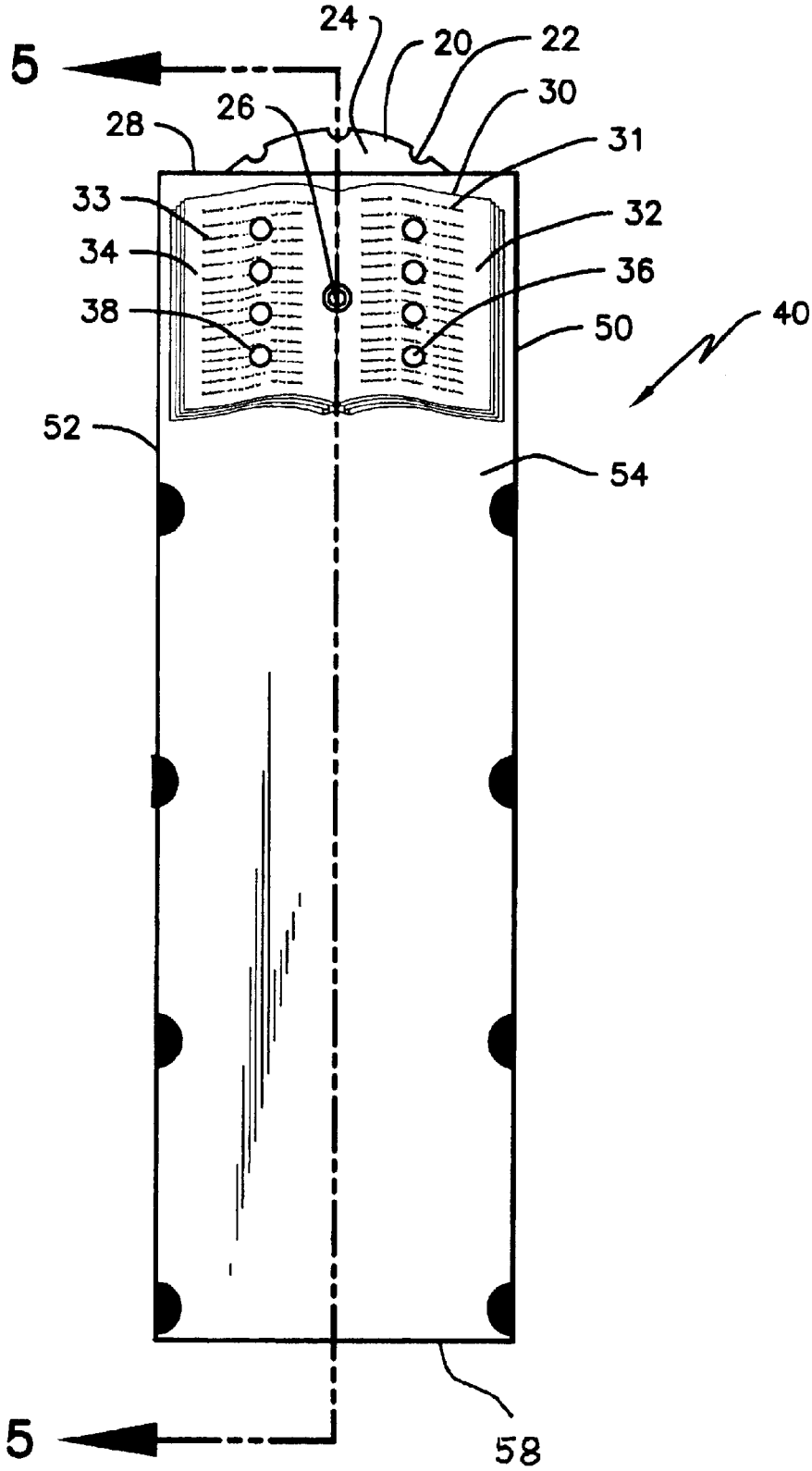
FIG. 1 is a view of sheet A of the bookmark
Figure 4:
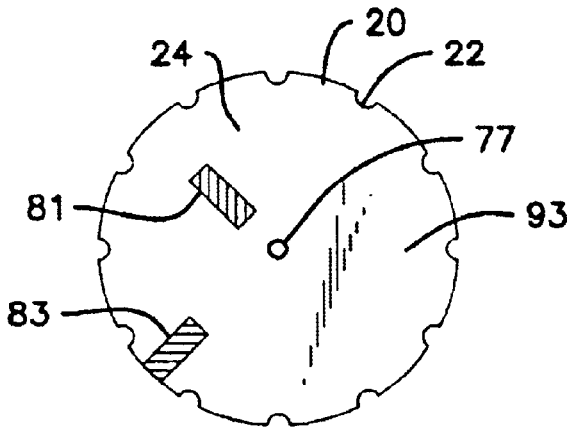
Figure 4A:
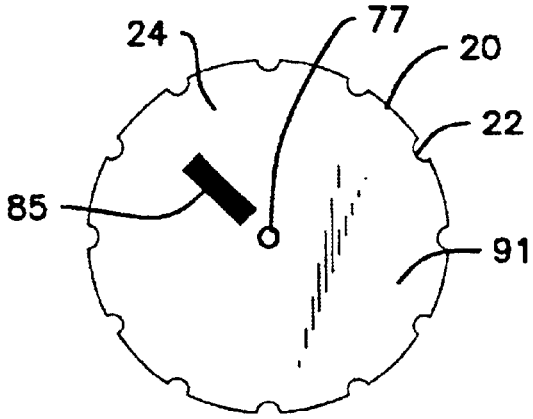
Figure 4B:
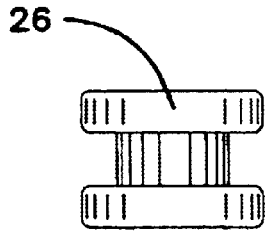
Figure 4C:
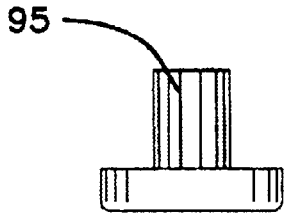
Figure 5:
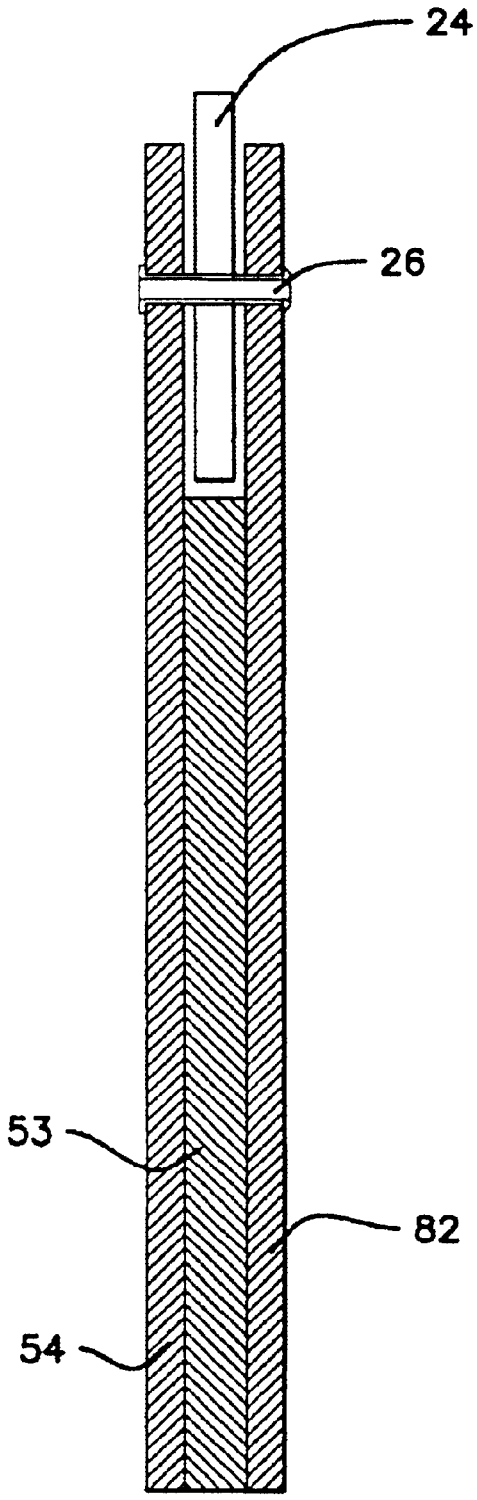

FIGS. 4, and 4A, illustrate the two sides of the adjustable highlighter device and its pivot rivet FIGS. 4B and 4C illustrate the pivot rivet of the adjustable highlighter device FIG. 5 is a view in detail of the bookmark indicated by the section lines 5—5 in FIG. 1

Figure 6:
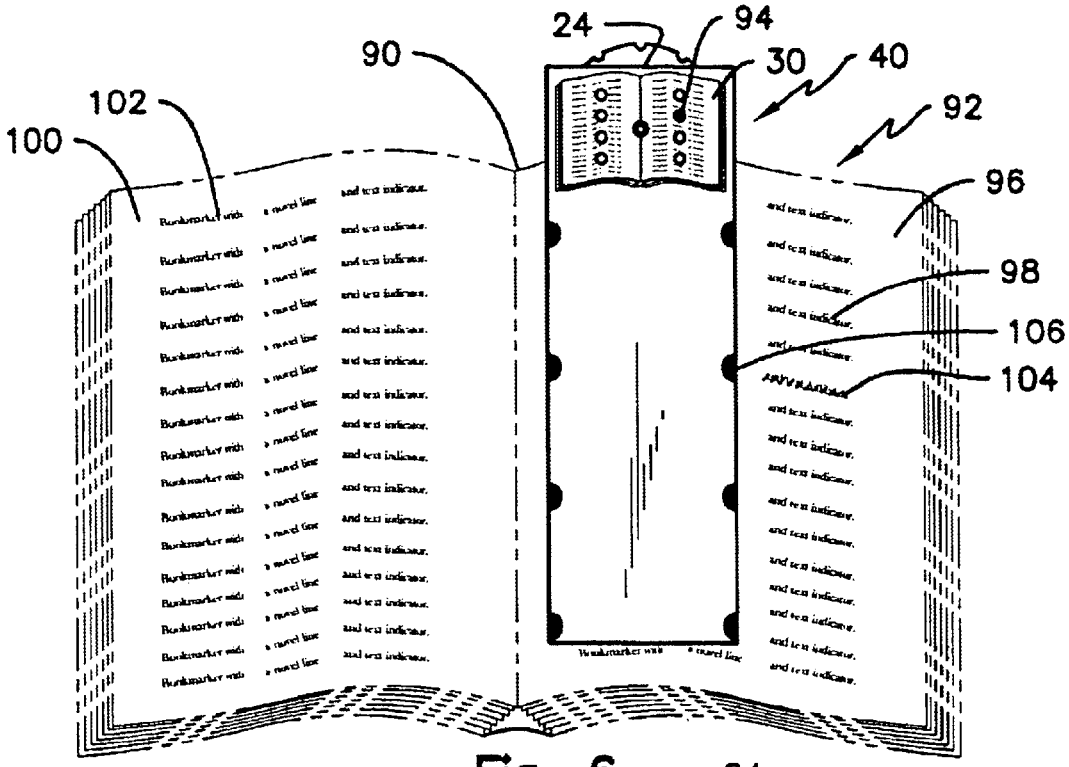

FIG. 6 is an illustration of the use of the bookmark to mark a line of text on the right page of a book with single column pages.

Figure 7:
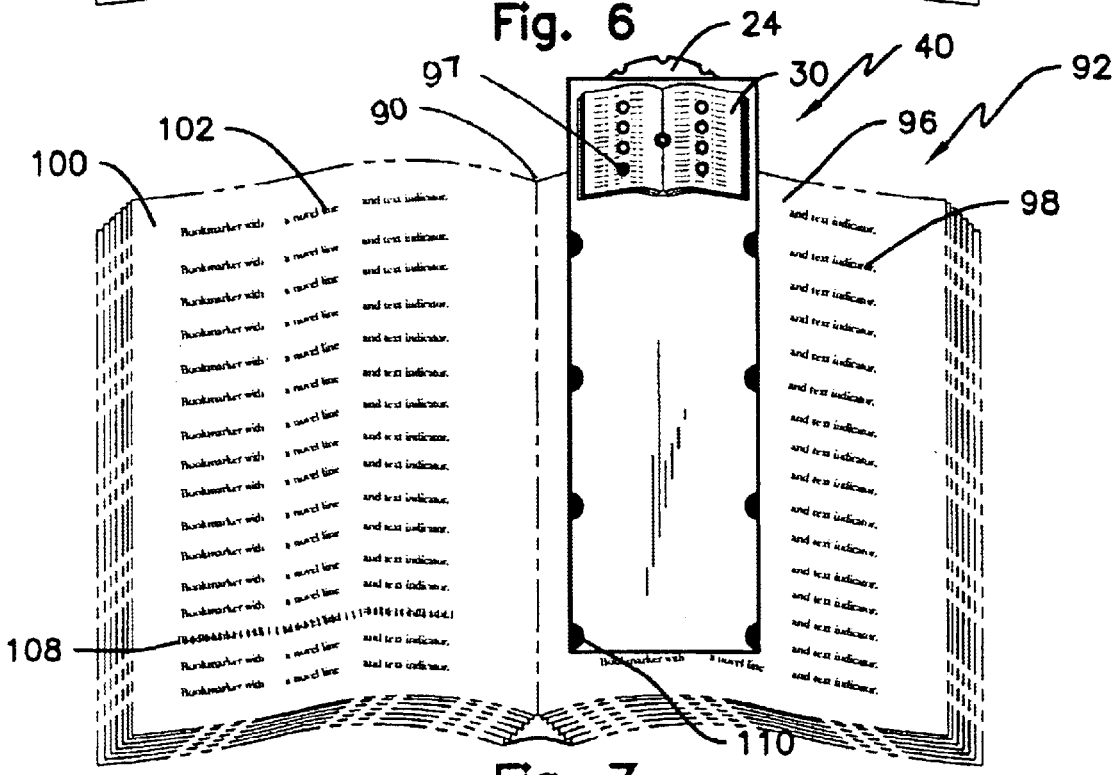

FIG. 7 is an illustration of the use of the bookmark to mark a line of text on the left page of a book with single column pages.

Figure 8:
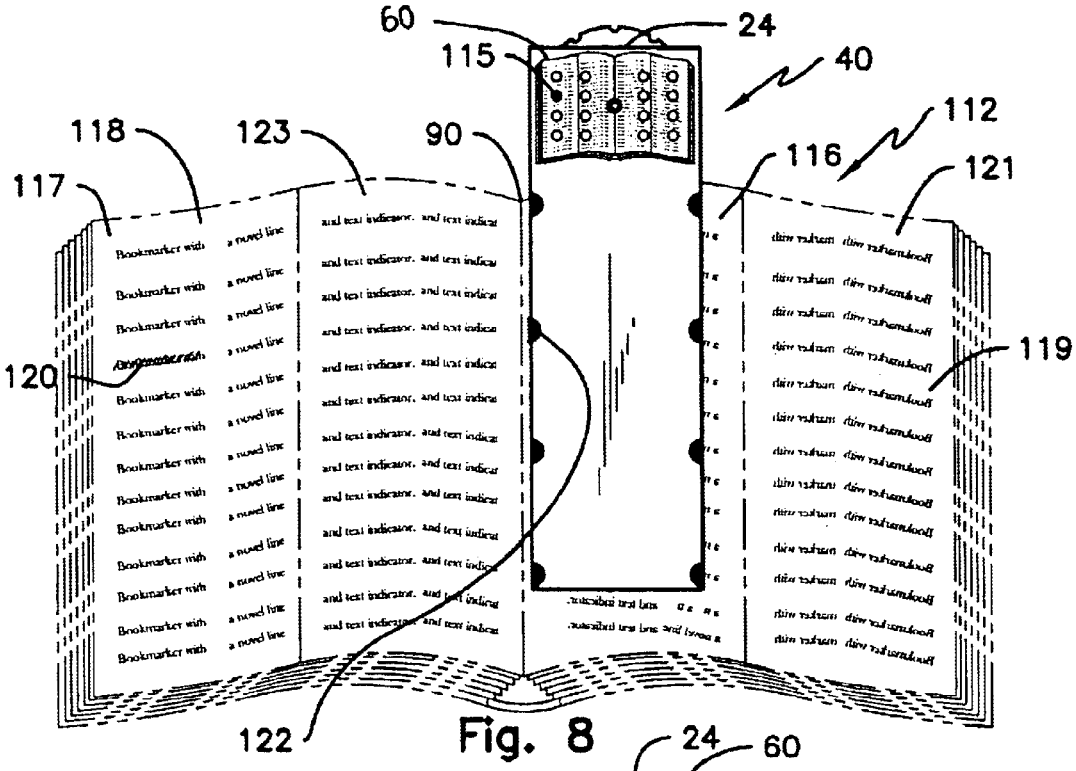

FIG. 8 is an illustration of the use of the bookmark to mark a line of text on the left column of the left page of a book with double column pages.

Figure 9:
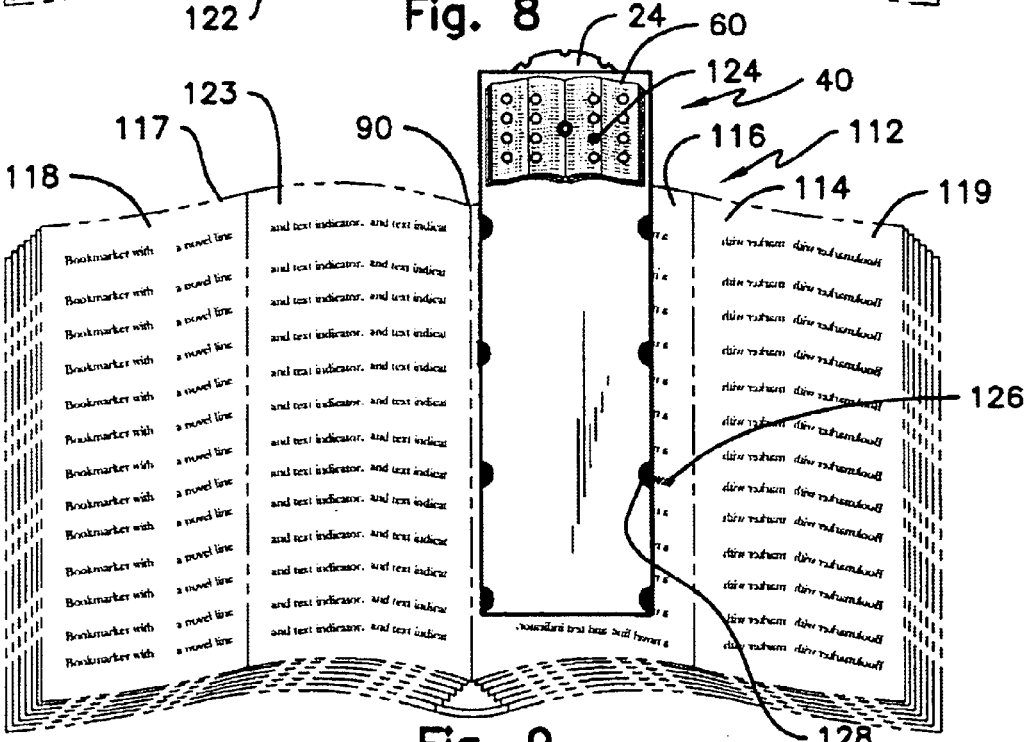

FIG. 9 is an illustration of the use of the bookmark to mark a line of text on the left column of the right page of a book with double column pages.

Figure 10:
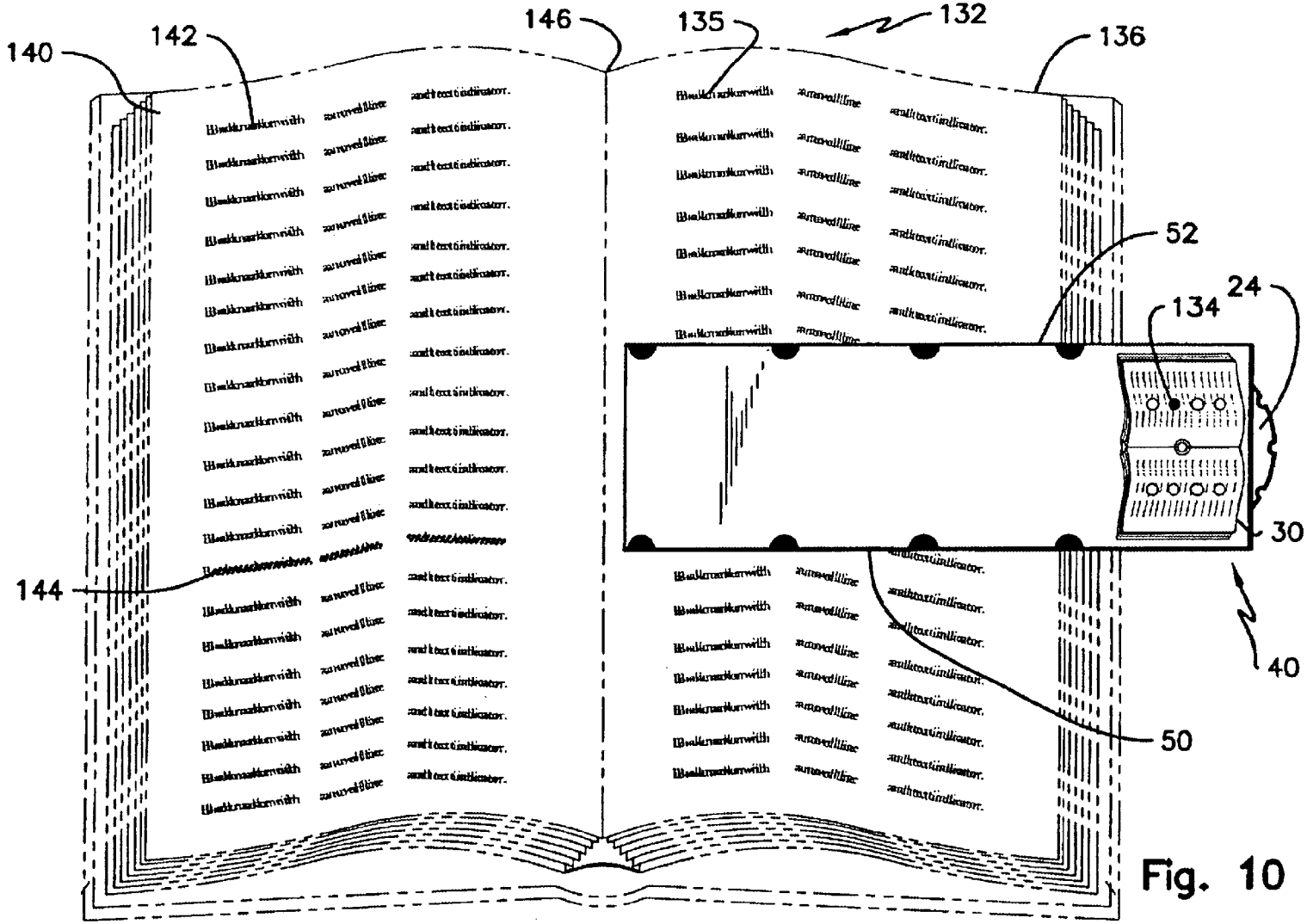

FIG. 10 is an illustration of the horizontal use of the bookmark to mark a line of text on the left page of a hard-cover book which is typically taller than a paperback book.

Figure 11A:
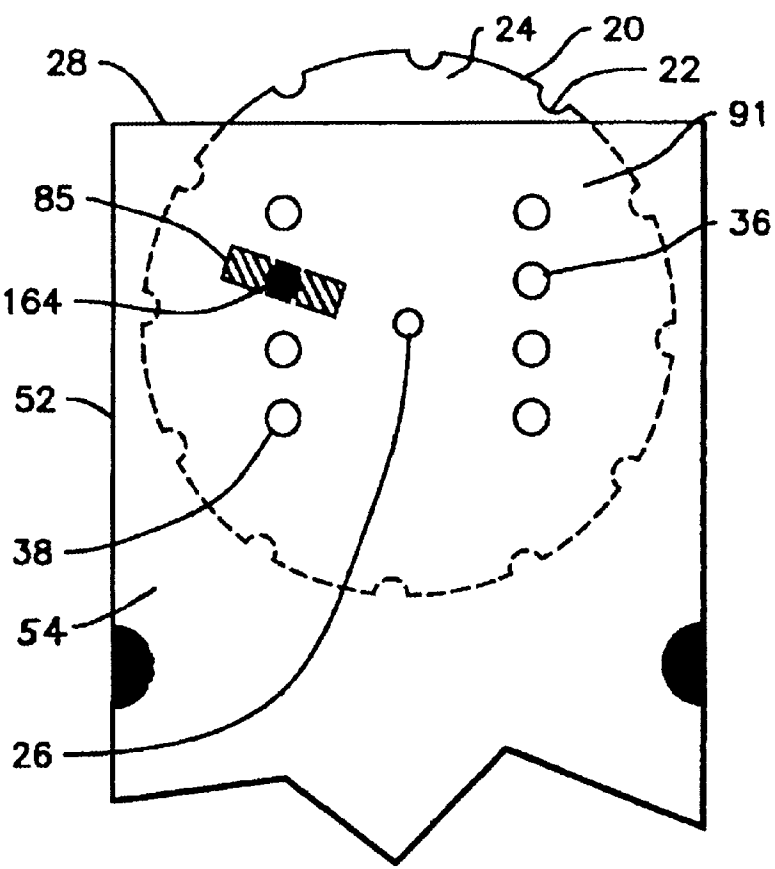
Figure 11:
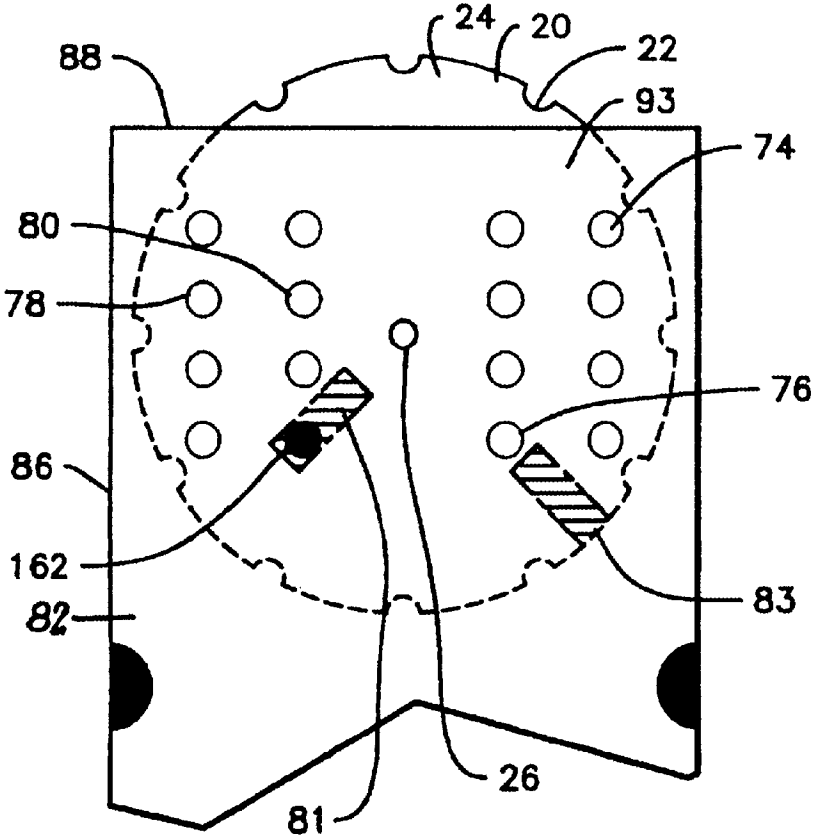
Figure 12:
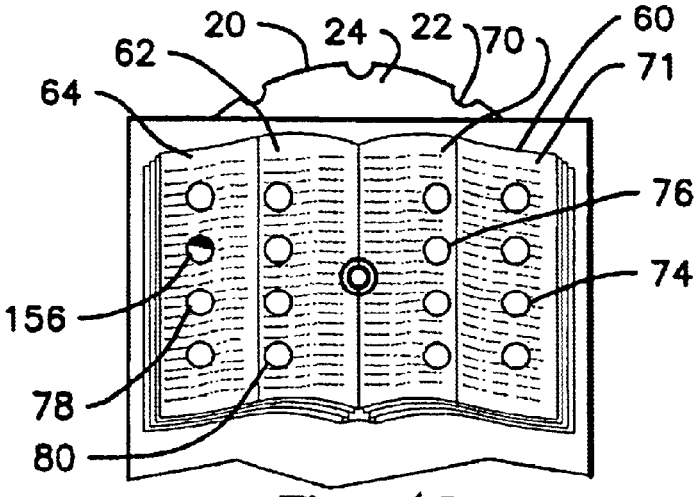
Figure 13:
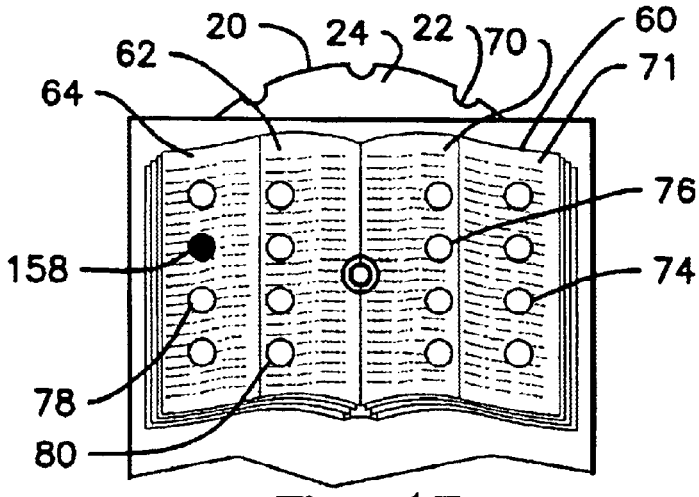
Figure 14:
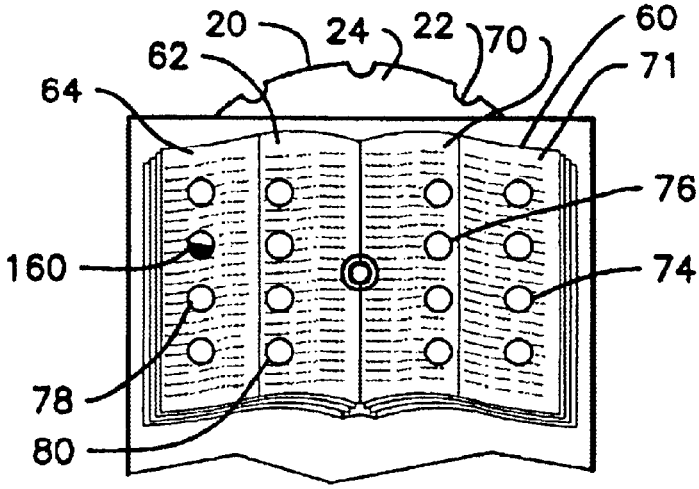

FIGS. 11 and 11A illustration of how the highlighter strips on the two sides of the adjustable highlighter device are used to highlight a single aperture on sheet A and a single aperture on sheet B of the bookmark FIG. 12 is an illustration of the use of the adjustable highlighter device in combination with the open book icon to mark the upper one-third of a quarter page column equal to one-twelfth of a column of text FIG. 13 is an illustration of the use of the adjustable highlighter device in combination with the open book icon to mark the middle one-third of a quarter page column equal to one-twelfth of a column of text FIG. 14 is an illustration of the use of the adjustable highlighter device in combination with the open book icon to mark the lower one-third of a quarter page column equal to one-twelfth of a column of text

DRAWINGS

Numerals

| | | | |
|---|---|---|---|
| 20 | adjustable highlighter device edge | 22 | adjustable highlighter device notches |
| 24 | adjustable highlighter device | 26 | pivot rivet |
| 28 | top horizontal edge | 30 | sheet A open book icon |
| 31 | sheet A icon right page text | 32 | icon right page |

-continued

| | | | |
|---|---|---|---|
| 33 | icon left page text | 34 | sheet A icon left page |
| 36 | sheet A icon right page apertures | 38 | sheet A icon left page apertures |
| 40 | bookmark | 50 | sheet A vertical right edge |
| 52 | sheet A vertical left edge | 53 | two-sided adhesive tape |
| 54 | opaque sheet A | 56 | half circle line of text markers |
| 58 | sheet A bottom horizontal edge | 60 | sheet B open book icon |
| 62 | sheet B icon left page right column | 64 | sheet B icon left page left column |
| 66 | sheet B icon left page | 68 | sheet B icon right page |
| 70 | sheet B icon right page left column | 71 | sheet B icon right page right column |
| 73 | sheet A rivet aperture | 74 | icon right page right column apertures |
| 75 | sheet B rivet aperture | 76 | icon right page left column apertures |
| 77 | adjustable device rivet aperture | 78 | icon left page left column apertures |
| 80 | icon left page right column apertures | 81 | adjustable device side B inner strip |
| 82 | opaque sheet B | 83 | adjustable device side B outer strip |
| 84 | sheet B vertical right edge | 85 | side A adjustable device strip |
| 86 | sheet B vertical left edge | 87 | sheet B bottom horizontal edge |
| 88 | sheet B horizontal top edge | 90 | book spine |
| 91 | adjustable highlighter device side A | 92 | single column page book |
| 93 | adjustable highlighter device side B | 94 | right page of icon highlighted aperture |
| 95 | rivet | 96 | book right page |
| 97 | left page of icon highlighted aperture | 98 | right page text |
| 100 | book left page | 102 | left page text |
| 104 | right page text line | 106 | 2nd quarter line of text marker |
| 108 | left page text line | 110 | 4th quarter line of text marker |
| 112 | double column page paperback book | 114 | right page right column |
| 115 | open book icon highlighted aperture | 116 | right page left column |
| 117 | left page | 118 | left page left column |
| 119 | right page | 120 | left page left column text line |
| 121 | right page right column | 122 | 2nd quarter line of text marker |
| 123 | left page right column | 124 | open book icon highlighted aperture |
| 126 | right page left column text line | 128 | 3rd quarter line of text marker |
| 132 | single column of text hardcover book | 134 | 3rd quarter highlighted aperture |
| 135 | right page text | 136 | book right page |
| 138 | right page text | 140 | book left page |
| 142 | left page text | 144 | left page text line |
| 146 | hardcover book spine | 156 | highlighted upper half 2nd quarter aperture |
| 158 | fully highlighted 2nd quarter aperture | 160 | highlighted lower half 2nd quarter aperture |
| 162 | sheet B single highlighted aperture | 164 | sheet A single highlighted aperture |

DESCRIPTION—FIGS. 1, 2, 3, 4, 4A, 4B, 4C and 5—PREFERRED EMBODIMENT

Detailed Description Overview

As illustrated in FIGS. 1, 2, 3, 4, 4A, 4B, 4C and 5, bookmark 40 is constructed of four pieces, an opaque front sheet A 54, an opaque back sheet B 82, an opaque adjustable highlighter device 24 and pivot rivet 26. All of the dimensions in the detailed descriptions were chosen arbitrarily and should not preclude other dimensions or form factors for the implementation of this invention. As illustrated in FIG. 5, rivet 26 and strips of two-sided adhesive tape 53 integrate all four pieces to become bookmark 40. This embodiment of bookmark 40 is constructed of poster-board material. This cardboard-like material is of a weight which has sufficient stiffness and strength to endure through repeated usage. The poster board material is typically about 0.38 mm thick and tape 53 is approximately 0.08 mm thick. Therefore, the three thicknesses, including device 24, are approximately 0.84 mm. This is thin enough to anchor bookmark 40 nicely when thrust toward the spine of a book. A detailed description of the preferred embodiment of bookmark 40 is given below:

Detailed Description Specifics

FIG. 1—Sheet A of Bookmark 40

The sheet 54 is rectangular in form and is of generally recognized conventional bookmark dimensions. For this embodiment, the height of vertical right edge 50 and vertical left edge 52 is chosen to be 165.0 mm, and the width of top horizontal edge 28 and bottom horizontal edge 58 is chosen to be 51.0 mm.

Illustrated at the top of FIG. 1 is device 24 sandwiched between sheet 54 and the rest of bookmark 40. Edge 20 with its notches 22 provides for rotating device 24. Icon 30, representing an image of an open book, is near edge 28. Icon 30 has a representation of a right page 32 with single column of text 31. Additionally, page 32 has a plurality of 3.0 mm diameter apertures 36. Apertures 36 each represent one quarter of text 31. Top aperture 36 represents the top one quarter of text 31. Second aperture 36 represents the second quarter of text 31. Third aperture 36 represents the third quarter of text 31. Bottom aperture 36 represents the fourth quarter of text 31.

Icon 30 also has a representation of a left page 34 with a single column of text 33. Page 34 has a plurality of 3.0 mm diameter apertures 38. Apertures 38 each represent one quarter of text 33. Top aperture 38 represents the top one quarter of text 33. Second aperture 38 represents the second quarter of text 33. Third aperture 38 represents the third quarter of text 33. Bottom aperture 38 represents the fourth quarter of text 33. These apertures, when individually highlighted by device 24, show which quarter of a page a reader has marked to indicate the stopping point.

On edge 52 of sheet 54 are a plurality of half circle markers 56 equally spaced vertically between each other. A corresponding plurality of markers 56 are placed on edge 50. They are also equally spaced vertically between each other and are positioned such that they are directly across from the corresponding markers 56 on edge 52 of sheet 54. The top pair of markers 56, across the sheet from each other, are $1^{st}$ quarter page text line markers. Next lower pair of markers 56 are $2^{nd}$ quarter page text line markers. Next to the last pair of markers 56 are $3^{rd}$ quarter page text line markers and the bottom pair of markers 56 are $4^{th}$ quarter page text line markers.

Figure 2:
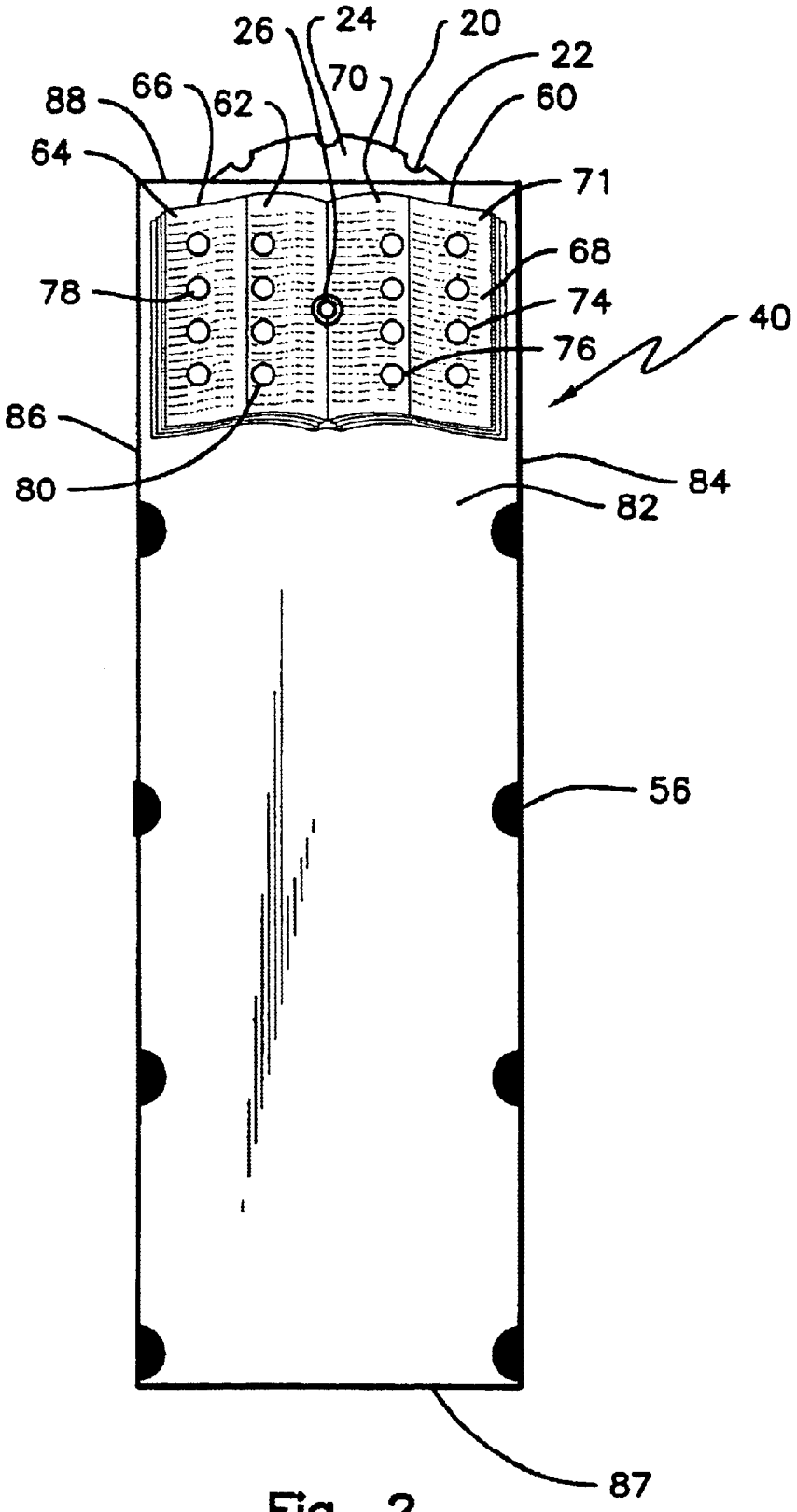
FIG. 2 is a view of sheet B of the bookmark

FIG. 2—Sheet B of Bookmark 40

Sheet 82 is rectangular in form and is of generally recognized conventional bookmark dimensions. For this embodiment, the height of vertical right edge 84 and vertical left edge 86 is chosen to be 165.0 mm and the width of top horizontal edge 88 and bottom horizontal edge 87 is chosen to be 51.0 mm.

Illustrated at the top of FIG. 2 is device 24 sandwiched between sheet 82 and the rest of bookmark 40. Edge 20 with its notches 22 provides for rotating device 24. Below edge 88 there is icon 60 representing an image of an open book. Icon 60 has a representation of a right page 68 with a right column 71 and a left column 70. Page 68 has a plurality of 3.0 mm diameter apertures 74 in column 71. Page 68 has a plurality of 3.0 mm diameter apertures 76 in column 70. Icon 60 also has a representation of a left page 66 with a right column 62 and a left column 64. Page 66 has a plurality of 3.0 mm diameter apertures 78 in column 64. There is also a plurality of 3.0 mm diameter apertures 80 in column 62. Apertures 74, 76, 78 and 80, when individually highlighted by device 24, show which quarter of a column a reader has marked to indicate the stopping point.

On edge 86 of sheet 82 there are a plurality of markers 56 equally spaced vertically between each other. A corresponding plurality of markers 56 are placed on edge 84. They are also equally spaced vertically between each other and are positioned such that they are directly across from the corresponding markers 56 on edge 86. The top pair of markers 56, across sheet 82 from each other, are $1^{st}$ quarter page text line markers. Next lower pair of markers 56 are $2^{nd}$ quarter page text line markers. Next to the last pair of markers 56 are $3^{rd}$ quarter page text line markers, and the bottom pair of markers 56 are $4^{th}$ quarter page text line markers.

Figure 3:
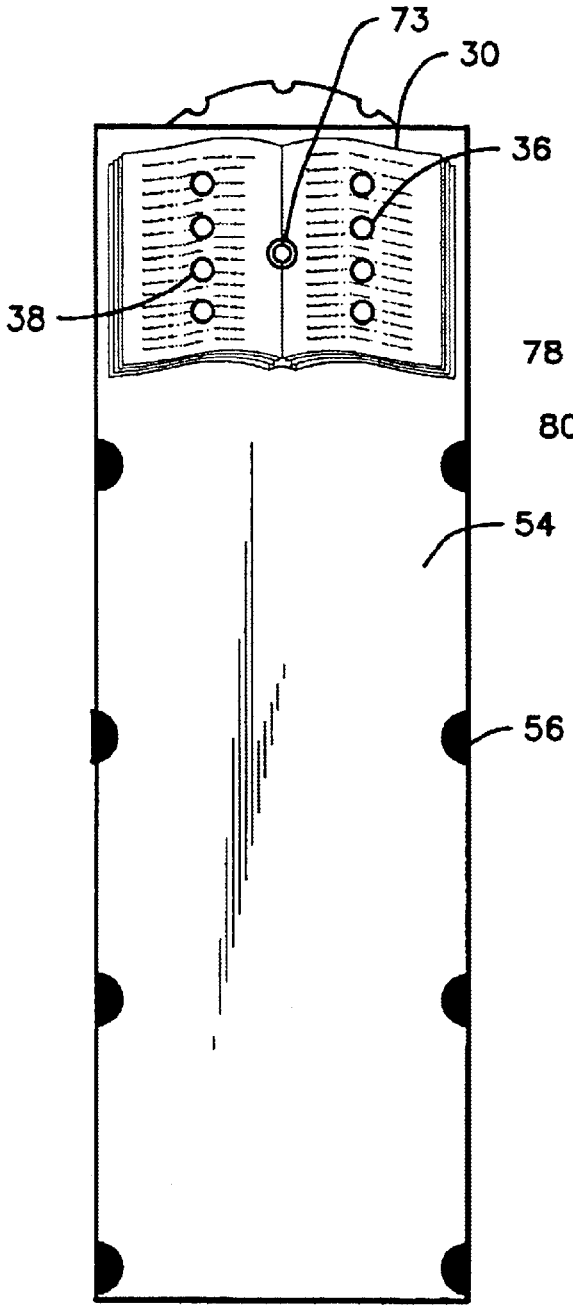
FIG. 3 is a view of the two rectangular sheets that make up the bookmark
Figure 3A:
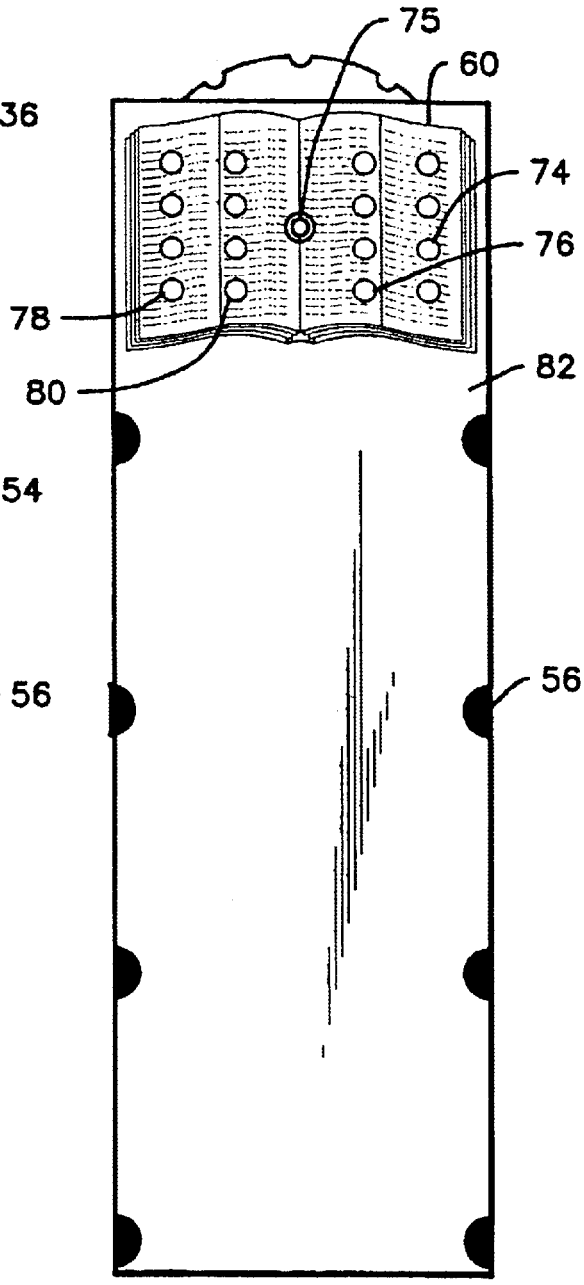

FIG. 3—Sheet A and Sheet B.

FIG. 3 shows a view of sheet 54 and sheet 82 side by side to clearly illustrate sheet 54 icon 30 and sheet 82 icon 60. The two sheets, along with device 24 and rivet 26, are the four parts that make up bookmark 40. Sheet 82 has twice the number of apertures in icon 60 compared to the apertures in icon 30. Neither of the apertures counts include aperture 73 and aperture 75

FIGS. 4, 4A, 4B and 4C—Adjustable Highlighter Device

FIGS. 4, and 4A are front and back views of device 24. Device 24 is free to rotate on rivet 26. The reader rotates device 24 with a thumb so as to bring a highlighting strip under a single aperture in icon 30 and icon 60. Side B 93 of device 24 has one highlighting strip 81 for the inner rows of apertures closest to rivet 26 on icon 60. Side B 93 also has another highlighting strip 83 for the outer rows of apertures farthest away from rivet 26 on icon 60. For this embodiment the following dimensions apply. Both strips are 3.0 mm wide. Strip 81 is positioned at a 90 degree angle to strip 83. Strip 81 extends 14.0 mm in a radial direction from the center of pivot aperture 77. Strip 83 extends 9.0 mm from edge 20 toward the center of pivot aperture 77. As shown in FIG. 4A, side A 91 of device 24 has only one highlighting strip 85 for the highlighting of any apertures 36 in icon 30. This strip is 3.0 mm wide and 11.0 mm long. It must extend at least 15.0 mm radially from the center of pivot aperture 77. Device 24 itself is 48.0 mm in diameter. This embodiment uses a black color for highlighting strips 81, 83, and 85. This is preferred for maintaining a high contrast against the body of the bookmark as an aperture is highlighted.

FIGS. 4, and 4A illustrate the notches 22 around circumferential edge 20 of device 24 to provide a good gripping surface for moving device 24. Pivot aperture 77 accepts rivet 95, shown in FIG. 4C, when device 24 is sandwiched between sheet 54 and sheet 82. Rivet 95, when riveted in place, becomes rivet 26. Rivet 26, as shown in FIG. 4B, holds sheet 54 and sheet 82 together near the top of bookmark 40 as well as providing device 24 stasis.

FIG. 5—Section through Bookmark

FIG. 5 depicts a view of section 5—5 through bookmark in FIG. 1. Device 24 is sandwiched between sheet 54 and sheet 82. The two sheets are held together on the lower portion of bookmark 40 by strips of tape 53 which have adhesive on each of their surfaces. The tape 53 is typically 0.008 mm thick. Sheet 54 and sheet 82 are each approximately 0.38 mm thick, which yields a thickness for bookmark 40 of approximately 0.84 mm. This thickness is thin enough to provide good retention and anchoring of bookmark 40 when thrust towards the spine of a book.

OPERATION

Operation—General Description—FIG. 1 and FIG. 2

When the reader decides to stop reading, he can estimate at which quarter of a page of text he is stopping. If he is in the second quarter of a page of text, he may move device 24 until it produces a highlighted aperture on either icon 30 or icon 60. The reader will pick the second aperture down from the top consistent with his location in the real book that he is reading. He then places bookmark 40 in the book. When he returns later, he observes what bookmark 40 indicates and resumes his reading in the indicated quarter of the page. This is easily done because the open book icon exhibits a likeness of a book similar to the actual book that he is reading. Assuming that he is reading a book with single column of text pages, he will use icon 30 of bookmark 40. If he is reading a book with double columns of text, he will use icon 60 of bookmark 40. Thus, his decision as to which open book icon to use is unambiguous. At this point, the reader may choose to use only this quarter page or quarter column marking feature for his book marking. Not only is it simple to use but, additionally, he will benefit by the bookmark's retention of his marking spot should it fall out when the book is opened.

However, is he likes, he may choose to also mark his stopping point to some single line-of-text in the quarter page of text indicated by the aperture highlighted icon 30 or icon 60. He can do this by using one of the corresponding pair of markers 56 below the open book icon 30 or icon 60. He does this by placing bookmark 40 in the book positioned such that the selected line marker 56 is aligned with the text line in the book that he chooses to mark. If he wants to mark a line on the left page of the book, he will use the left most marker of the pair. Conversely, if he wants to mark a line on the right page of the book, he will use the right most marker of the pair. Bookmark 40 is then held vertically and thrust toward the spine of the book The pressure of the two pages that bookmark 40 is sandwiched between provides for its retention in the book.

Operation—Detailed Description—FIGS. 6, 7, 8, 9, 11, 11A, 12, 13, 14

FIG. 6 illustrates the procedure to be used when using bookmark 40 to mark a line of text 104 on right page 96 of a single-column book 92. Device 24 sets the highlighting of the second quarter section of text aperture 94 on icon 30. The second quarter line marker 106 is positioned next to line 104 and then bookmark 40 is thrust toward spine 90 of book 92 for retention.

FIG. 7 provides an illustration for marking a line of text 108 on left page text 102 of left page 100 of book 92. Device 24 sets the highlighting of the fourth quarter section of text aperture 97. Aperture 97 is the lowest aperture in the fourth quarter of left page text so it directs the reader to the use of $4^{th}$ quarter text section line marker 110. Line marker 110 is positioned next to line 108 and, as before, bookmark 40 is thrust toward spine 90 of book 92 for retention.

FIG. 8 illustrates the use of bookmark 40 in book 112 with double-column pages. In this example, the reader wants to mark line of text 120 of left column 118 of left page 117. To do this, he adjusts device 24 until the second aperture 115 on the left page of open book icon 60 is highlighted. This indicates that the $2^{nd}$ quarter page of text has been selected on the left page 117 of icon 60. Now the reader uses the second quarter marker 122 and places it adjacent to text 120 to be marked. The reader then thrusts bookmark 60 toward spine 90 of book 120 for its retention.

FIG. 9 illustrates the technique for marking text line 126 on left column 116 of right page 119 of book 112. Here again, device 24 is used to highlight an aperture 124 in the third quarter of icon 60. Thus, on page 119, the $3^{rd}$ quarter line marker 128 is lined up with line 126 to be marked. Bookmark 40 is then thrust toward spine 90 of book 112 for retention.

In summary, FIGS. 6, 7, 8, and 9 have illustrated that through the novel use of 4 pair of line markers on each side of bookmark 40, it is possible for any line to be marked on a full page of a book without moving the bookmark vertically more that one quarter page of text.

FIG. 10 illustrates the technique that may be used to mark text line 144 in hard-cover book 132 that would normally cause bookmark 40 to be lost in book 132 if it were to be inserted vertically in marking a text line at the bottom of page 140. However, bookmark 40 may suitably be used in its present form if it is inserted horizontally to mark any line in a hard-cover book. Again, device 24 is used to highlight aperture 134 in icon 30. The aperture indicates that the text line to be marked is in the third quarter of text section 142 of page 140. In the illustration, when used horizontally in a book, the reader uses edge 50 or edge 52 of bookmark 40 to mark the desired text line 144. In this illustration, edge 50 of bookmark 40 is used because highlighted aperture 134 is in the lower half of icon 30. If a highlighted aperture were to be in the upper half of icon 30, the edge 52 of bookmark 40 would be used to mark the desired text line. Once positioned to line 144, bookmark 40 is thrust towards spine 146 of book 132 for retention.

FIGS. 11 and 11A illustrate how device 24 is used to highlight an aperture in either of the two open book icon images. As shown in FIG. 11, there are two highlighter strips on side 93. There is an inner strip 81 and an outer strip 83. They are placed so that strip 81 and strip 83 are ninety degrees apart on side 93. As device 24 is rotated through one rotation of three hundred and sixty degrees, the entire plurality of apertures on icon 60 on sheet 82 will be highlighted one aperture at a time. As shown in FIG. 11A, similar highlighting of the plurality of apertures on icon 30 on sheet 54 will likewise be highlighted, one aperture at a time, during one rotation of device 24. Each of the apertures represents a quarter of a page of text. The uppermost aperture represents the top one quarter of a page of text in the book that he is reading. The second aperture down represents the second quarter of a page of text in the book being read. The third aperture down represents the third quarter of a page of text in the book being read, and the bottom aperture represents the fourth quarter of a page of text in the book being read.

FIGS. 12, 13 and 14—These figures are used to illustrate the alternative approach to marking a section of text. In the previous examples, the reader may have observed that the line of text marked, using the half circle markers or the bookmark edges, will be lost if the bookmark falls out when the book is opened. Because of this, if the reader desires, he may instead choose to use another technique to mark his spot. With this technique, he may mark his spot to within five lines or more in tall hard-cover books which generally have as many as 60 lines per page. For reference purposes, a soft-cover book may have approximately 45 lines of text per page. This technique will preserve the reader's spot to five lines or more of text, depending on the number of lines of text per page, even if the bookmark should fall out when opening the book.

The alternative approach technique uses an uncommon highlighting of an aperture to divide a quarter section of text into three sections. The aperture is highlighted in three ways to accomplish this. The three are: a) upper half only highlighted aperture 156, b) fully highlighted aperture 158, and c) lower half only highlighted aperture 160. Each represents ⅓ of a ¼ of section of text equating to five lines in a book with sixty lines per page. Therefore, if the reader chooses, he may adjust the highlighting of $2^{nd}$ quarter aperture 78 to only ½ coverage represented by aperture 156 as illustrated in FIG. 12. This would mark five lines of text in the upper third of the quarter page. If the reader adjusts the device 24 to completely highlight aperture 158, as illustrated in FIG. 13, this would mark the five lines in the middle of the quarter page of text. As shown in FIG. 14, if the reader adjusts device 24 to highlight the lower half of aperture 160, this will mark the lower 5 lines of the quarter page of text. The five lines may approximate two or three sentences or a paragraph in many books. In a single-column, book this technique will mark a stopping point to one-twelfth of a page. In a book with double-column pages this technique will mark a stopping point to one-twenty-fourth of a page.

CONCLUSIONS, RAMIFICATIONS AND SCOPE

Conclusion

Accordingly, the reader will see that the bookmark, with the adjustable highlighter device and the alterable open book icon, can easily be used to mark the spot in any book where reading may be resumed. The bookmark is easy to use since the primary marker element consists of a likeness of an open book. Since this marker appears very much like the actual book being read, it is easy to determine how the marker is to be set. The adjustable highlighter device provides a means for highlighting one of 8 marker apertures on the front sheet A icon and one of the 16 marker apertures on the back sheet B icon. This allows the reader to mark within a quarter page of text in a single-column text or to an eighth of a page in double-column texts. The bookmark can mark a single line of text in any page of text or any column of text. This marking is facilitated by the use of four pair of text markers per side, one pair each to use for each quarter section of text. Selecting the proper one of the four marker pairs on a side insures that the bookmark need not be moved vertically more than one quarter of a book's page when marking a single line of text.

Also, an alternate technique is provided for marking a sentence or a paragraph of five lines or more of text. The bookmark will preserve which page of text was marked, which column of text was marked and which five lines of text were marked, even if the bookmark was to fall out on opening the book. The reader, on picking up the bookmark, will know which icon to use, either icon 30 or icon 60, by observing how many columns are in the book that he has been reading.

The adjustable highlighter device allows the book marking to be done through the use of only one hand. The bookmark needs no arrows, no lines, no numbers or alphanumeric characters to be able to set the bookmark to a quarter page of text, a quarter column of text, a line of text, or a section of text of five lines indicating where to commence reading. This bookmark can be used for both paperback books and for larger hard-cover books. The bookmark is inexpensive to fabricate since it has only three parts and a rivet.

Ramifications and Scope

Although the descriptions given in this specification contains many specifics, these should not be construed as limiting the scope of the invention but as merely providing illustrations of some of the preferred embodiments of this invention. Some other embodiments for consideration can include the following:

The bookmark can also be made of metal, wood or a synthetic material.

The color of the bookmark can be changed to improve general appeal and contrast.

The design can be scaled up or down to adapt to various sized books or for personal preferences.

The number of parts can be reduced by using a single sleeve rather than the two front and reverse sheets.

A locking device can be added to increase the stasis of the adjustable highlighter device.

A reduced cost design can be made by having only one sheet and only one open book icon for each type of book.

The open book icon can have larger or smaller dimensions to satisfy personal preferences.

The apertures on the open book icon can be in the form of stars, squares, slits, grooves, rectangles or other shapes.

The apertures can be replaced by a single vertical rectangular slot per column to make the marking continuously variable from 0% through 100% of a column of text.

Instructions for the user can be added to the front and reverse surfaces of the bookmark.

The open book icon can be replaced by a photograph of an appropriate book.

Different colors can be used for the highlighting strips on the adjustable highlighter device for best contrast to the color of the body of the bookmark.

The adjustable highlighter device can be of a different shape, such as hexagonal or octagonal, rather than circular.

The notches on the adjustable highlighter can be increased or reduced in number and can be of a different shape.

Two additional alterable open book icons can be added to the bookmark to provide for books with three and four columns per page supported by a second adjustable highlighter device.

In summary, the scope should be determined by the appended claims and their legal equivalent, rather than the examples given.

I claim:

1. A bookmark with an alterable image of an open book, comprising:

a) a first sheet with a first image on the first side of said first sheet with an aperture for each quarter section of page text, and b) a second sheet with a second image on the second side of said second sheet with an aperture for each quarter section of column text, and c) a device, between said first and second sheets with a plurality of strips, at least one strip on each side of said device, for highlighting any one of said individual section apertures, and a plurality of line-of-text markers on at least one of said sides of said first and second sheets.

2. The bookmark of claim 1 wherein one of said book image aperture is highlighted by said strips.

3. The bookmark of claim 1 wherein one of said line-of-text marker is selected by said book image and said highlighter strips.

4. A bookmark with line and text locators, comprising:

a) a first sheet with a first icon on the first side of said first sheet with a plurality of apertures depicting an open book with single column of text pages, and b) a second sheet with a second icon on the second side of said second sheet with a plurality of apertures depicting an open book with double columns of text pages, and c) a device between said first and second sheets for highlighting a single aperture of any one of said apertures in said icons.

5. The bookmark of claim 4 wherein said bookmark contains a plurality of line-of-text markers on at least one of said sides of said first and second sheets.

6. The bookmark of claim 5 wherein the means of selecting one of said line-of-text marker is provided by said icons and said highlighter device.

* * * * *